US005440902A

United States Patent [19]

Wieland et al.

[11] Patent Number: 5,440,902

[45] Date of Patent: Aug. 15, 1995

[54] WARP KNITTED FABRIC AND A MACHINE AND PROCESS FOR FORMING SAME

[75] Inventors: Jakob Wieland, Rodgau; Herman Kraner, Obertshausen, both of Germany

[73] Assignee: Karl Mayer Textilmachinenfabrik GmbH, Germany

[21] Appl. No.: 229,699

[22] Filed: Apr. 19, 1994

[30] Foreign Application Priority Data

Apr. 20, 1993 [DE] Germany ..... 43 12 706.1

[51] Int. Cl.[6] ..... D04B 21/02

[52] U.S. Cl. ..... 66/194; 66/204

[58] Field of Search ..... 66/191, 192, 194, 195, 66/83, 87, 204, 205

[56] References Cited

U.S. PATENT DOCUMENTS

| | | | |
|---|---|---|---|
| 3,213,646 | 10/1965 | Van Patten | 66/191 |
| 3,857,260 | 12/1974 | Zwingenberger et al. | 66/204 X |
| 4,546,026 | 10/1985 | Kowalski | 66/194 X |
| 4,712,281 | 12/1987 | Scheller | 66/194 X |
| 5,150,587 | 9/1992 | Bergmann | 66/204 X |
| 5,257,515 | 11/1993 | Ikeguchi | 66/192 |
| 5,284,034 | 2/1994 | Weis et al. | 66/204 X |

FOREIGN PATENT DOCUMENTS

| | | | |
|---|---|---|---|
| 2263575 | 7/1974 | Germany | 66/195 |
| 2435312 | 9/1976 | Germany . | |
| 3545791 | 5/1987 | Germany . | |

*Primary Examiner*—John J. Calvert

*Attorney, Agent, or Firm*—Omri M. Behr; Matthew J. McDonald

[57] ABSTRACT

A warp knitted fabric is formed with pile. The ground fabric is formed by a first ground lap with threads (11) forming stitches (18) with a separation of n wales (19), and a second ground lap with threads laid-in and running in the same direction. The pile is formed by a pile lap, in which each thread (12) forms stitches (18) with a separation of m wales (19). Herein, n is at least 1 and m is at least 0. In a process for the preparation of warp knitted fabric, the lay-in is so provided that the successive turn-around points of the lapping movement has a separation of approximately n+1 needle spaces. A warp knitting machine comprises a first ground guide bar (L2), a second ground guide bar (L1), a pile guide bar (L3) and a pile sinker bar (PB) with the appropriate displacement control arrangements (14 through 17) which operate in the manner of the foregoing displacement movements.

6 Claims, 2 Drawing Sheets

Fig.1
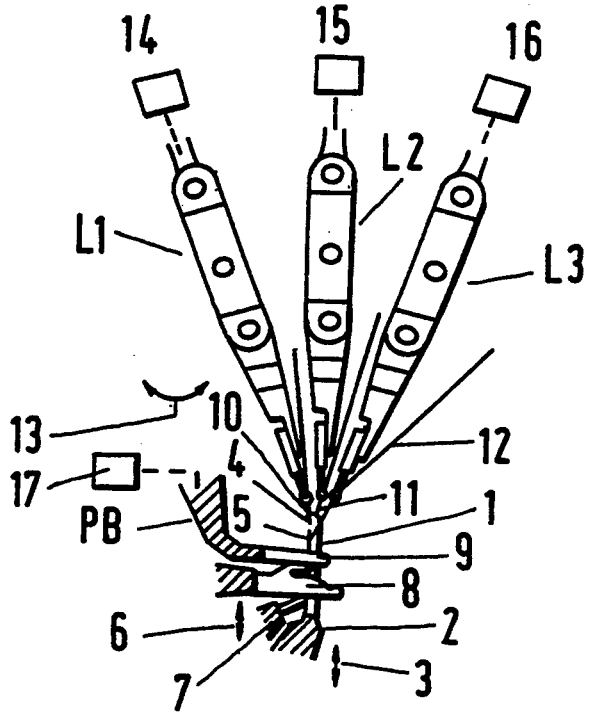
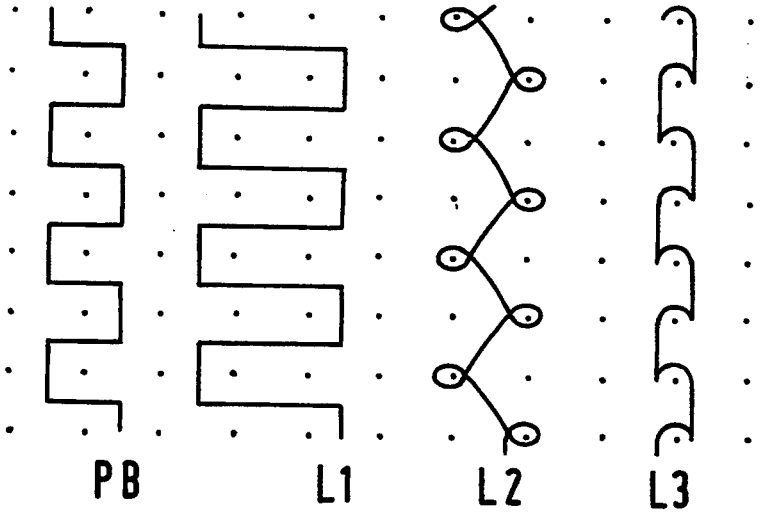
Fig.2
Fig.3
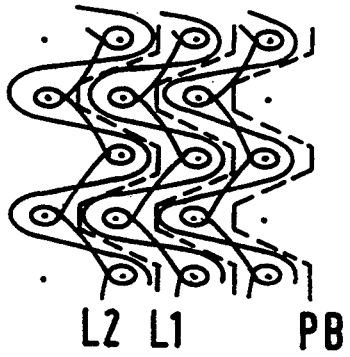
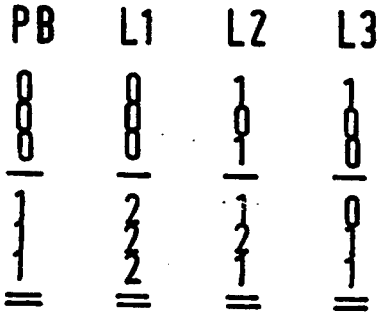
Fig.4

WARP KNITTED FABRIC AND A MACHINE AND PROCESS FOR FORMING SAME

BACKGROUND OF THE INVENTION

1. Field of the Invention

The present invention is directed to:

A. Pile-containing, warp knitted fabric whose ground fabric is formed by a first ground lap (each thread therein builds stitches with a separation of n wales), a second ground lap, and a pile lap in which each thread builds stitches in a separation of m wales; wherein n is at least 1 and m is at least 0 but is unequal to n.

B. A corresponding process for the production of warp knitted fabric wherein the ground fabric comprises a first stitch (forming a ground lap over needles which have a separation of n needle spaces) a second ground lap, and a stitch forming pile lap over needles which have a separation of m needle spaces, by the crossing of pile sinkers resting in the needle gaps, which pile sinkers are displaced by n needle spaces in the same direction as the first ground lap; wherein n is at least 1 and m is at least 0 but is unequal to n, C. A warp knitting machine for the formation of warp knitted fabric having: a needle bar with needles, a first ground guide bar whose displacement is so controlled by a first control arrangement that the stitches are formed on needles which have a separation of n needle spaces, a second ground bar with a second control arrangement, a pile lap bier whose displacement is controlled by a third control arrangement so that the stitches are formed on needles with a separation of m needle spaces, and a sinker bar whose sinkers remain in the needle spaces and whose displacement by a fourth control arrangement is so controlled that it runs in the same direction was the first ground guide bar but displaced by n needle spaces; wherein n is at least 1 and m is at least 0 but is unequal to n.

2. Description of Related Art

German Patent DE 24 35 312 discloses a warp knitting machine for the formation of pile loops wherein the pile sinkers remain in the needle gaps. In order that the fully occupied needles can produce a tricot ground fabric, the pile sinker bar Is displaceable by one needle space.

In accordance with German Patent DE PS 35 45 791, the thus produced warp knitted fabric can be strengthened by a second ground lap which is in the form of a chain stitch. So that this thread system does not however form pile loops, it is only possible to form the stitches in each second work cycle. The strengthening action Is therefore limited and can only apply to longitudinal stability. In each case, the two foot points of a pile loop are on the same side of a wale. Thus, the thread tension forces of the tricot lap which act in a diagonal direction, lead to a twisting of the knotted in pile loops. This leads to the tipping of individual loops which gives an unclean washed-out appearance to the product.

When there is subsequently utilized a shearing process, one may try to surmount this disadvantage by a deeper cut of the pile loops. This however leads to a higher loss of material and requires in most cases a plurality of shearing passes, which leads to higher costs.

Accordingly, there is a need for an improved warp knitted fabric of the hereinbefore described type which has a higher stability.

SUMMARY OF THE INVENTION

In accordance with the illustrative embodiments demonstrating features and advantages of the present invention, there is provided a pile-containing, warp knitted fabric having a base fabric having a first and second ground laps. The threads of the first ground lap each form successive stitches with a separation of n wales. The second ground lap has threads formed as a lay-in. The threads of the second ground lap (a) are laid in the same direction as threads of the first ground lap, and (b) have successive turning points lying in the area of wales having a separation of n wales. The fabric also has a pile lap. Each thread of the pile lap builds successive stitches with a separation of m wales. Herein, n is at least 1, and m is at least 0 and unequal to n.

In a related process of the same invention warp knitted fabric is produced with a machine having needles and pile sinkers. The process includes the step of building stitches with a first ground lap over successive needles which have a separation of n needle spaces. Another step is laying a second ground lap as a lay-in with threads laid in the same direction as the first ground lap, This second ground lap has a lapping movement with successive turn-around points separated by approximately n+1 needle spaces. Another step in the process is forming stitches and pile with a pile lap over successive needles which have a separation of m needle spaces, by crossing pile sinkers resting in spaces between adjacent needles. Another step is displacing pile sinkers by n needle spaces in the same direction as the first ground lap. Herein, n is at least 1 and m is at least 0 and unequal to n.

A related warp knitting machine of the same invention can form warp knitted fabric. The machine has a needle bar having needles and a first ground guide bar having a first control arrangement. The first control arrangement can control displacement of the first ground guide bar to form on successive needles, stitches separated by n needle spaces. The machine also includes a second ground guide bar having a second displacement arrangement for controlling displacement of the second ground guide bar. This second control arrangement causes the second ground guide bar to run in the same direction as the first ground guide bar, but displaced by n+1 needle spaces. Also included is a pile guide bar having a third control arrangement for controlling displacement of the pile guide bar to form stitches on successive needles with a separation of m needle spaces. The machine also includes a pile sinker bar having a fourth control arrangement for controlling the pile sinker bar to run in the same direction as the first ground lap bar but with a displacement of n needle spaces. The pile sinker bar has a plurality of sinkers that remain in the needle spaces, wherein n is at least 1 and m is at least 0 and unequal to n.

In a preferred embodiment the second ground lap is a lay-in, whose threads are laid in the same direction as threads of the first ground lap, and whose turning point lies in the area of wales which have a separation of n stitch wales.

By causing the laid-in threads of the second ground lap to run the same direction as the threads of the first ground lap, the effect of their thread tension on one foot point of the pile loop pulls it from one side of the stitch to the other side. This has the result that the pile loop has a diagonal lay in which the diagonally acting thread tension force of the first ground lap does not cause it to tip. Thus, the pile loops are substantially more stable in form end can be sheared with a much lower shearing loss, where heretofore, one considered the need for a 15% shearing less, now the loss is reduced to between 6 and 7%.

The weft threads of the second ground lap similarly run diagonally and thus in the same way give rise to an increase in both longitudinal and transverse stability. Thus, such warp knitted fabric can be utilized as a covering material for automobile parts where an even deformation is desired. The warp knitted fabric has no tendency to buckle, and hence is similarly suitable for clothing materials.

A further advantage lies therein that the second ground lap requires no hook space in the needle. One can therefore completely utilize the hook space by the first ground lap and the pile lap and additionally achieve a strengthening effect.

It is furthermore significant that the lay-in on a warp knitting machine can be achieved with a displaceable pile sinker bar whose pile sinkers are permanently protruding through the needle gaps. This is possible since the lay-in runs in the same direction as the first ground lap and thus the lay-in threads and the pile sinkers do not cross.

It is particularly desirable to provide a warp knitted fabric wherein the first ground lap is laid as tricot and the pile lap as chain stitch wherein the threads to the second ground lap are laid in between neighboring wales, since it is possible to operate with the simple tricot and chain stitches.

The process of the present invention solves the problem in that the second ground lap is a lay-in whose threads are laid in the same direction as the first ground lap, and wherein the turn-around point of the lapping movement have a distance of approximately n+1 needle spaces.

When the lapping action is so provided that the turn-around point has a separation of n+1 needle spaces, the lay-in threads can be laid in the ground fabric without being affected by the to and fro motion of the pile sinkers. Under the influence of the thread tension, the lay-in threads can affect the lie of the pile loops and provide them with a more stable form.

These advantages are particularly important in the embodiment wherein the first ground lap is formed as tricot and the pile lap as chain stitch and wherein during the formation of the second ground lap as lay-in, it is displaced by two needle spaces, The problem is furthermore solved by a warp knitting machine wherein the second control arrangement causes the second ground guide bar to run the same direction as the first ground guide bar, however displaced by n+1 needle spaces. In the simplest case, three guide bars will suffice to form a pile fabric with a highly stable ground and very stable pile.

In a further embodiment where the first control arrangement displaces the ground guide bar to form a tricot lap, the third control arrangement displaces the pile guide bar from a chain stitch and the fourth control arrangement displaces the pile sinker bar by one needle space. The second control arrangement (14) displaces the second ground guide bar (L1) by two needle spaces therefore the displaceable bars are subjected to the smallest possible displacement movement so that the warp knitting machine may work rapidly and with high productivity.

BRIEF DESCRIPTION OF THE DRAWINGS

The invention may be further explained by means of the preferred embodiments illustrated in the drawings which show:

FIG. 1 is a schematic representation of the work area of a warp knitting machine in accordance with the present invention;

FIG. 2 is a lapping diagram of the displaceable guide bars of the warp knitting machine controlled by the control arrangements;

FIG. 3 is a lapping diagram in which the individual motions for the provision of the ground fabric are shown over each other;

FIG. 4 is a pattern chain displacement schedule for the individual bars;

DETAILED DESCRIPTION OF THE PREFERRED EMBODIMENTS

Figure 5:
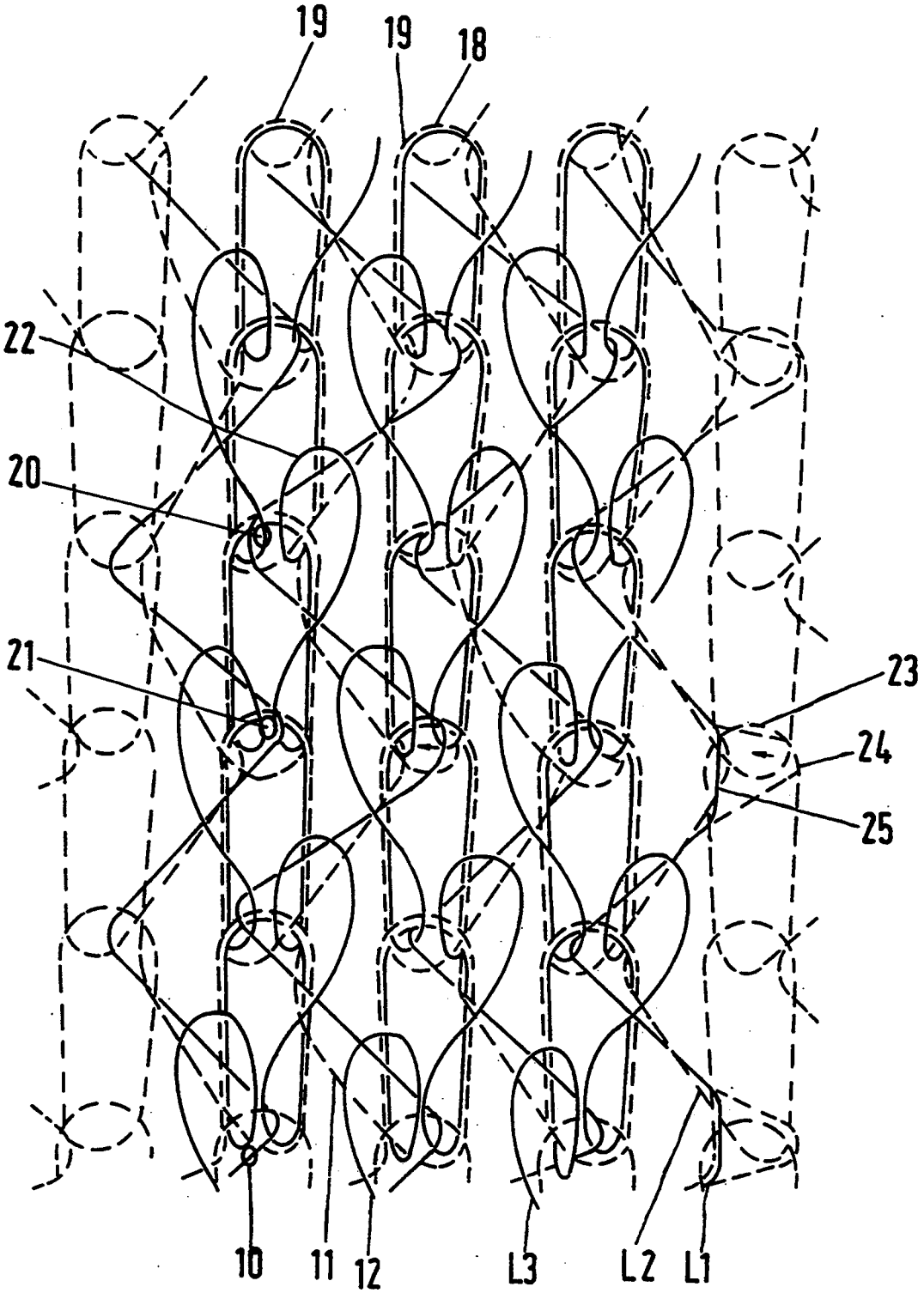
FIG. 5 to the warp knitted fabric in accordance with the present invention.

As shown in FIG. 1, the working area of the warp knitting machine illustrates needles 1 in needle bar 2, which are moveable in the up and down direction shown by arrow 3. Their hook space 4 is closeable by slider 5 which are mounted in a slider bar 7, moveable up and down in direction of arrow 6.

Further, there is provided a closing and knock-over sinker 8 and pile sinkers 9, which latter sinkers are attached to pile sinker bar PB and continuously stay in the needle spaces between needles 1.

Three guide bars L1, L2 and L3, which hereinafter will be designated as first ground guide bar L2, second ground guide bar L1 and pile guide bar L3, carry the guides which lead threads 10, 11 and 12 of the appropriate thread system. These guide bars are swingable in the direction illustrated by arrow 13 and are similarly displaceable perpendicular to the plane of the illustration by control arrangements 14, 15 and 16. The pile sinker bar is also provided with such a displacement control arrangement 17.

Such bar displacement control arrangements are conventional. Generally, they comprise pattern chain segments, cam disks, electronically controlled stepping motors, or the like.

FIG. 2 shows one embodiment for such a guide bar displacement. In the usual manner, the adjacently lying dots each represent a needle 1. The needle rows following each other represent the same needles in successive work cycles. The pile sinker bar PB is moved beck and forth over one needle space so that the pile sinker 9 is moved out of one needle space to the neighboring needle space and back. The first ground guide bar L2 lays tricot and thus forms stitches alternately on neighboring needles 1. Such a lapping mode does not collide with the movement of the pile sinkers.

In contrast thereto, the pile guide bar L3 provides a chain stitch in which the threads produce stitches over the same needle 1. This causes a crossing with pile sinker 9 so that pile loops are formed. The second ground guide bar L1 provides a lay-in wherein the turn-around occurs after two needle spaces. Thus the threads do not form a stitch but are only bound into the stitches of the other lapping systems.

As illustrated in FIG. 3, this lapping mode does not collide with the movement of the pile sinker bar PB so that the lay-in gives rise to an increase in the stability of the groundware.

FIG. 4 shows the displacement control program for the chain segment settings for the individual bars.

FIG. 5 illustrates the fabric produced by the present invention. It may be readily seen that the first ground guide bar L2 lays the threads 11 as tricot stitch. The pits guide bar L3, whose pile threads 12 are laid as chain stitches, form stitches 18 which create adjacent wales 19. The foot points 20 and 21 of the pile loop 22 are alternately located first on one and then on the other side of stitch 18 of each wale 19. These pile loops 22 can be readily caused to tip by diagonal tension which is exercised by the tricot lap of the first guide bar L2. This is prevented by the lay-in thread 10 of the second guide bar L1. The lay-in threads 10 are so laid, as shown in phantom area 23, that the turn-around point 24 of the lapping motion has a separation of two needle spaces.

By means of the thread tension of the lay-in thread and the simultaneous binding in by undertap of the adjacent tricot bind, the turn-around point 24 is pulled in the direction of the next turn-around point so a new turn-around point 25 is produced. This in turn causes the foot point 21 of pile loop 22 to be pulled to the opposite side of stitch 18. The foot points are securely anchored in the ground fabric and lead to a diagonal positioning of the pile loops 22. This avoids a twisting of the pile loops 22 and assists in maintaining them in a upright position.

In sum, this yields a high pile stability. At the same time, the wales are pulled more closely together. This gives rise to a regular form, stable pile formation and a closer quality of fabric.

Since the threads 10 are only placed before needles 1, that is to say, not in the hook space 4, the range of application with respect thread thickness and density of goods can be increased.

Many variations are possible from the preferred embodiment without departing from the basic idea of the invention. For example, keeping the other parameters the same, the pile lap can be laid as a cloth lap (2×1 lap). The displacement of the guide bars in sequential work cycles can run in the same direction or in opposite directions. Similarly, the first guide bar can lay atlas instead of tricot, provided the lapping movement of the remaining guide bars is appropriately adjusted.

When, for example, the pile sinker bar is displaced by two needle spaces, the first ground lap can be cloth lap (2×1 lap) and the pile lap can be tricot. Further variations will become apparent when the numbers n and m are other whole numbers.

We claim:

1. Pile-containing, warp knitted fabric having a base fabric comprising:

a first ground lap having threads, each thread of said first ground lap forming successive stitches with a separation of n wales; and a second ground lap having threads formed as a lay-in, said threads of said second ground tap (a) being laid in the same direction as threads of the first ground lap, and (b) having successive turning points lying in the area of wales having a separation of n wales; said fabric further comprising:

a pile lap having threads, each thread of said pile lap building successive stitches with a separation of m wales, n being at least 1, m being at least 0 and being unequal to n.

2. Warp knitted fabric in accordance with claim 1 wherein the first ground lap is laid as tricot stitches, and the pile lap is laid as chain stitches, threads of said second ground lap being laid in between neighboring wales.

3. Process for the production of warp knitted fabric with a machine having needles and pile sinkers, comprising the steps of:

building stitches with a first ground lap over successive needles which have a separation of n needle spaces;

laying a second ground lap as a lay-in with threads laid in the same direction as the first ground lap, said second ground lap having a lapping movement with successive turn-around points separated by approximately n+1 needle spaces;

forming stitches and pile with a pile lap over successive needles which have a separation of m needle spaces, by crossing pile sinkers resting in spaces between adjacent needles; and displacing pile sinkers by n needle spaces in the same direction as the first ground lap, n being at least 1 and m being at least 0 and unequal to n.

4. Process in accordance with claim 3 wherein the first ground lap is tricot and the pile lap is chain stitch, and wherein the second ground lap, during formation as lay-in, is displaced by two needle spaces.

5. Warp knitting machine for the formation of warp knitted fabric, comprising:

a needle bar having needles;

a first ground guide bar having a first control arrangement for controlling displacement of said first ground guide bar to form on successive needles, stitches separated by n needle spaces;

a second ground guide bar having a second displacement arrangement for controlling displacement of said second ground guide bar to deliver lay-in thread, the second control arrangement causing the second ground guide bar to run in the same direction as the first ground guide bar, but displaced by n+1 needle spaces;

a pile guide bar having a third control arrangement for controlling displacement of said pile guide bar to form stitches on successive needles with a separation of m needle spaces; and a pile sinker bar having a fourth control arrangement for controlling the pile sinker bar to run in the same direction as the first ground lap bar but with a displacement of n needle spaces, said pile sinker bar having a plurality of sinkers that remain in the needle spaces, wherein n is at least 1 and m is at least 0 and unequal to n.

6. Warp knitting machine in accordance with claim 5 wherein the first control arrangement is operable to displace the first ground guide bar to form a tricot lap, the third control arrangement being operable to displace the pile guide bar to form a chain stitch, the fourth control arrangement being operable to displace the pile sinker bar by one needle space, the second control arrangement being operable to displace the second ground guide bar by two needle spaces.

* * * * *